US006824943B2

(12) United States Patent
Gambayashi

(10) Patent No.: US 6,824,943 B2
(45) Date of Patent: Nov. 30, 2004

(54) TONER FOR ELECTROSTATIC IMAGE DEVELOPMENT

(75) Inventor: Hideki Gambayashi, Ageo (JP)

(73) Assignee: Dainippon Ink and Chemicals, Inc., Tokyo (JP)

( * ) Notice: Subject to any disclaimer, the term of this patent is extended or adjusted under 35 U.S.C. 154(b) by 0 days.

(21) Appl. No.: 10/372,276

(22) Filed: Feb. 25, 2003

(65) Prior Publication Data

US 2003/0198882 A1 Oct. 23, 2003

(30) Foreign Application Priority Data

Feb. 28, 2002 (JP) ..... 2002-053590

(51) Int. Cl.[7] ..... G03G 9/09

(52) U.S. Cl. ..... 430/108.6; 430/108.2; 430/108.3

(58) Field of Search ..... 430/108.2, 108.3, 430/108.6

(56) References Cited

U.S. PATENT DOCUMENTS

| | | | | |
|---|---|---|---|---|
| 5,199,983 A | | 4/1993 | Katamoto | |
| 5,378,571 A | * | 1/1995 | Macholdt et al. | 430/108.2 |
| 5,427,884 A | * | 6/1995 | Ohtani et al. | 430/108.2 |
| 6,194,115 B1 | | 2/2001 | Nagase et al. | 430/110 |
| 6,335,139 B1 | | 1/2002 | Gambayashi et al. | |
| 6,514,654 B1 | * | 2/2003 | Kanbayashi et al. | 430/108.3 |
| 2002/0132177 A1 | | 9/2002 | Sawada et al. | |
| 2003/0059699 A1 | | 3/2003 | Tachi et al | |
| 2003/0138714 A1 | * | 7/2003 | Hayashi et al. | 430/108.3 |
| 2003/0152858 A1 | | 8/2003 | Osan et al. | |

FOREIGN PATENT DOCUMENTS

| | | | | |
|---|---|---|---|---|
| EP | 0 402 026 A2 | | 12/1990 | |
| JP | 60-207150 | | 10/1985 | |
| JP | 63-100468 | | 5/1988 | |
| JP | 63-157167 | | 6/1988 | |
| JP | 3-2276 | | 1/1991 | |
| JP | 8-34617 | | 2/1996 | |
| JP | 2000-319021 | | 11/2000 | |
| JP | 2001-66821 | | 3/2001 | |
| JP | 2001-66830 | | 3/2001 | |
| JP | 2001-109201 | | 4/2001 | |
| JP | 2002-129063 | | 5/2002 | |
| JP | 2002129063 A | * | 5/2002 | G03G/9/083 |
| JP | 2002-169337 | | 6/2002 | |
| JP | 2002-221821 | | 8/2002 | |
| JP | 2002-278131 | | 9/2002 | |
| JP | 2003-35973 | | 2/2003 | |
| WO | WO98/29783 | | 7/1998 | |
| WO | WO98/36327 | | 8/1998 | |

OTHER PUBLICATIONS

Diamond, Arthur S. (editor) Handbook of Imaging Materials. New York: Marcel–Dekker, Inc.(1991), pp. 163–170.*
Information Offer Form with English translation dated Feb. 3, 2004 against JP 2003–9550.
Information Offer Form with English translation dated Feb. 3, 2004, against JP 2003–45706.

* cited by examiner

*Primary Examiner*—Christopher Rodee
(74) *Attorney, Agent, or Firm*—Armstrong, Kratz, Quintos, Hanson & Brooks, LLP

(57) ABSTRACT

The present invention provides a toner for electrostatic image development which employs a black colorant free from a toxic substance and exhibits stable charge behavior even after extended use or printing of a large number of sheets, thus making it possible to provide printed images having sufficient image density without causing toner dispersion, fogging, and variation in image density. This is a toner for electrostatic image development comprising a binder resin and a colorant, wherein the colorant is made of black fine particles obtained by coating the surface of titanium dioxide particles with a complex oxide of titanium and iron.

11 Claims, No Drawings

TONER FOR ELECTROSTATIC IMAGE DEVELOPMENT

BACKGROUND OF THE INVENTION

1. Field of the Invention

The present invention relates to a black toner for electrostatic image development which can provide high-quality images with less surface contamination in an electrostatic image developing apparatus operated at a speed ranging from low to high speed, and which is also free from toxic substances.

2. Description of the Related Art

As a black pigment in a toner for electrostatic image development, carbon black and black iron oxide (magnetite) have exclusively been employed heretofore. Carbon black is a pigment which is generally cheap and is in the form of a powder having a fine particle diameter, and is also superior in colorability. However, carbon black is inferior in handling properties and operability because it is a bulky powder having a bulk density of 0.1 g/cm$^3$. Also carbon black is classified into Group 2B (possibly carcinogenic to human) by the International Agency for Research on Cancer and a problem related to safety and health has been pointed out.

On the other hand, black iron oxide (magnetite) powders have aggregation properties because $Fe_3O_4$ is magnetic and it is difficult for them to mix with other toner materials. They are also converted into brown $Fe_2O_3$ at about 150° C. and are inferior in heat resistance.

The characteristics required for a black colorant employed in a toner for electrostatic image development include, for example, colorability, safety, handling properties during manufacture, heat resistance, and electrical characteristics which exert an influence on developing properties. Electrical characteristics are important among the characteristics required for the colorant. The electrical characteristics can be subdivided into charging characteristics, being able to retain charges for a long period, charge uniformity (charge amount distribution), and charge environmental stability. Various factors exert an influence on these electrical characteristics and examples thereof include dispersibility, electrical resistivity, and surface physical properties of the colorant. If the colorant has poor electrical characteristics, the charge amount of each of the toner particles becomes non-uniform and the charge amount distribution is widened. Also the proportion of the number of particles having charges in the opposite polarity and the number of insufficiently charged particles increases causing dispersion of the toner in the apparatus during development and fogging wherein the toner adheres onto the non-image portion of a print. Furthermore, the resulting toner is likely to have poor durability, that is, the image density and resolution vary after extended use or printing of a large number of sheets.

Various materials have hitherto been studied to overcome the drawbacks of carbon black and black iron oxide (magnetite) and to develop a novel material to replace them. Among these materials, Japanese Unexamined Patent Application, First Publication No. Hei 3-2276 proposes a black particle powder made of polycrystalline particles comprising $Fe_2TiO_5$ and a $Fe_2O_3$—$FeTiO_3$ solid solution and also discloses a technique relating to a toner employing the same. An object of this publication is to provide a black colorant which is safe and innoxious and which is also superior in operability and heat resistance. However, the black colorant does not provide the electrical characteristics of the toner employing the black particle powder. Also the black colorant does not have sufficient blackness suited for use as the black colorant, and therefore a large amount of the black particle powder must be employed to provide sufficient blackness of the toner. Such a toner has an increased specific gravity and is likely to cause dispersion of the toner in the developing apparatus due to stirring together with a carrier in the developing apparatus, or due to a centrifugal force applied during the rotation of a development sleeve.

Japanese Unexamined Patent Application, First Publication No. 2000-319021 proposes a black particle powder comprising iron oxide (magnetite) particles and a titanium component in an amount of 0.3 to 3.5% by weight in terms of titanium atoms, and a toner employing the same. Furthermore, Japanese Unexamined Patent Application, First Publication No. Hei 8-34617 proposes a black magnetic iron oxide particle powder comprising iron oxide (magnetite) particles and a titanium component in an amount of 0.5 to 10.0% by weight in terms of titanium atoms, and a toner employing the same. However, iron oxide (magnetite) cannot sufficiently maintain charges on the toner because it has conductivity, and is likely to cause aggregation between particles because it has magnetism, and thus it is difficult to obtain a black toner having sufficient coloring strength.

As described above, the prior art does not disclose a technique which overcomes the drawbacks of carbon black and black iron oxide (magnetite) and does not disclose a toner employing a novel black colorant capable of sufficiently providing the electrical characteristics of the toner.

BRIEF SUMMARY OF THE INVENTION

In consideratin of the above, the present invention has been completed and an object thereof is to provide a toner for electrostatic image development which employs a black colorant free from toxic substances and which exhibits stable charge behavior even after extended use or printing of a large number of sheets, thus making it possible to provide printed images having sufficient image density without causing toner dispersion, fogging, and variation in image density.

The present inventors have made intensive studies and found that the above object can be achieved by employing a toner using black fine particles obtained by coating the surface of titanium dioxide particles with a complex oxide of titanium and iron, and thus the present invention has been completed.

The present invention provides a toner for electrostatic image development comprising a binder resin and a colorant, wherein the colorant is made of black fine particles obtained by coating the surface of titanium dioxide particles with a complex oxide of titanium and iron.

The black fine particles employed in the toner for electrostatic image development of the present invention are fine particles obtained by coating the surface of titanium dioxide particles with a layer containing a complex oxide of titanium and iron, and therefore, unlike magnetite, they are low-magnetism fine particles. Therefore, they can be uniformly dispersed in a binder resin because of poor aggregation properties between the particles. Also the complex oxide of titanium and iron is a black oxide and black fine particles are particles having good dispersibility. Therefore, the toner employing the same is a toner having an excellent degree of blackness. Due to excellent dispersibility, black fine particles are uniformly included in the respective toner particles. Therefore, non-uniformity of the charge amount between toner particles disappears, thereby making it possible to reduce the number of insufficiently charged particles. Furthermore, black fine particles employed in the toner for electrostatic image development of the present invention contain, as the core, titanium oxide having a specific gravity smaller than that of the complex oxide of titanium and iron and magnetite. Therefore, the true specific gravity of the toner of the present invention becomes smaller than that of the toner employing magnetite or a complex oxide of titanium and iron in the form of a simple substance. Therefore, even if the toner is transferred to a rotating body, such as a stirring member or development sleeve in a developing apparatus, toner dispersion resulting from centrifugal force can be remarkably reduced.

The toner for electrostatic image development of the present invention, which employs black fine particles obtained by coating the surface of titanium dioxide particles with a complex oxide of titanium and iron, exhibits stable charge behavior even after extended use or printing of a large number of sheets, thus making it possible to print without causing toner dispersion, fogging, and variation in image density.

DETAILED DESCRIPTION OF THE INVENTION

The present invention will now be described in detail. The colorant employed in the present invention is made of black fine particles obtained by coating the surface of titanium dioxide ($TiO_2$) particles with a complex oxide of titanium and iron. With such a composition, the colorant employed in the present invention is a colorant having a high degree of blackness. The complex oxide of titanium and iron includes oxides with various compositions. Specific examples thereof include $FeTiO_3$, $Fe_2TiO_4$, and $Fe_2TiO_5$. Among these, the colorant employed in the present invention is preferably a complex oxide having a spinel structure represented by $Fe_2TiO_4$ (Iron Titanium spinel).

Since the color hue varies depending on the particle diameter, the black colorant employed in the present invention preferably has a primary particle diameter within 0.05 to 0.4 $\mu$m, more preferably from 0.1 to 0.4 $\mu$m, and particularly preferably from 0.15 to 0.3 $\mu$m. The particle diameter of titanium oxide as the core of the colorant is preferably within a range from 0.02 to 0.38 $\mu$m, more preferably from 0.08 to 0.38 $\mu$m, and particularly preferably from 0.12 to 0.28 $\mu$m. The shape of black colorant may be spherical, needle-like, or amorphous, and is preferably spherical in view of fluidity.

The color hue of the black colorant employed in the present invention varies depending on the ratio of titanium atoms to iron atoms included in the particles. When employed as the black pigment, the weight ratio of Ti:Fe is preferably within a range from 30:70 to 70:30, more preferably from 45:55 to 55:45, and still more preferably from 48:52 to 52:48.

The preferred range of values of the physical properties of the black colorant employed in the present invention will now be described. The specific surface area as measured by the BET method is preferably within a range from 1.5 to 20 $m^2/g$, and more preferably from 3 to 10 $m^2/g$. The pH is preferably within a range from 5.5 to 8.5, and more preferably from 6 to 8. The oil absorption amount is preferably within a range from 20 to 40 g/100 g, and the moisture content is preferably 0.5% by weight or less. The bulk density is preferably within a range from 0.3 to 0.6 g/ml, and more preferably from 0.35 to 0.55 g/ml.

Because of low magnetism, the black colorant employed in the present invention is suited for use as a colorant for non-magnetic toner. When employed in a non-magnetic toner, the lower the magnetic characteristics are, the better. For example, Hc (coercive force) is preferably 40 kA/m or less, $\sigma s$ (saturation magnetization) is preferably 20 $Am^2/kg$ or less, and $\sigma r$ (residual magnetization) is preferably 10 $Am^2/kg$ or less. The magnetic characteristics are determined by a vibrating sample magnetometer VSM, manufactured by Riken Denshi Hambai K. K. (applied magnetic field: 397.9 kA/m).

Other conditions in the measurement by the VSM are as follows.

Internal volume of sample cells: 56.55 $mm^3$
Sample amount: 85.0 to 96.1 mg
Sample packing density: 1.50 to 1.70 $g/cm^3$
Measuring temperature: 22.5±2.5° C.
Measuring humidity: 50±10%

The colorant employed in the present invention must have a high degrees of blackness, and L* in the L*a*b* color specification system (which is a color specification system defined in JIS Z 8729, in which L* denotes lightness, and a* and b* denote chromaticity) is preferably 25 or less, and more preferably 20 or less. Although a* and b* are preferably closer to 0, they are practically within a range from −3 to 3.

L*, a*, and b* of the colorant are measured by the following method.

3 g of a colorant is charged in a cell for powder of a color difference meter (SE-2000, manufactured by Nippon Denshoku Kogyo Co., Ltd.), and after tapping from a height of 5 cm five times, the chromaticity is measured by the reflection method.

The optical reflectance as a black colorant is preferably 8% or less, and more preferably 6% or less, within the entire wavelength range of light. When the reflectance increases within a specific wavelength range, a deviation in color hue occurs. Comparing the reflectance every wavelength when a difference in the maximum value and the minimum value of the reflectance is 3% or less, the deviation in color hue is reduced which is preferred.

When printing by employing the toner for electrostatic image development of the present invention, the printing conditions are preferably set so that the values measured by the color difference meter (SE-2000, manufactured by Nippon Denshoku Kogyo Co., Ltd.) are as follows: L* is 35 or less, a* is within a range from −3 to 3, and b* is within a range from −3 to 3.

A commercially available product of the black colorant providing the above physical properties is, for example, ETB-100 (manufactured by TITAN KOGYO KABUSHIKI KAISHA) which is preferable as the black colorant employed in the present invention.

The amount of the black colorant employed in the present invention is preferably within a range from 3 to 18 parts by weight, and particularly preferably from 5 to 15 parts by weight, based on 100 parts by weight of the toner. When the amount is 18 parts by weight or less, the true specific gravity of the toner can be reduced and toner dispersion is less likely to occur during development, which is preferred.

The true specific gravity of the toner for electrostatic image development of the present invention is preferably 1.50 or less, and more preferably from 0.70 to 1.45.

The true specific gravity of the toner is a value measured by an air-relative specific gravity hydrometer, Model 930 (manufactured by Beckman Co.). In the measurement, after accurately weighing about 5 g of a sample to four decimal places, the true volume is determined under the conditions of 2 atm employing the measuring apparatus, and then the true specific gravity is determined by dividing the weight of the sample by the true volume.

In the present invention, the above black colorant is employed, and conventionally known colorants can be employed for the purpose of controlling the color hue. Examples of black colorants include carbon blacks which are differentiated based on their method of preparation, such as furnace black, channel black, acetylene black, thermal black, and lamp black; iron oxide pigments such as C.I. Pigment Black 11; aniline black; and phthalocyanine pigments such as cyanine black BX. The black colorant obtained by coating the surface of titanium oxide particles with a composite oxide of titanium and iron employed in the present invention is characterized by being free from toxic substances, and the object of the present invention is to provide a toner for electrostatic image development free from toxic substances. Therefore, when employing in combination with carbon black, it is necessary to sufficiently take note of the content of toxic substances and the amount of carbon black employed in combination with the black colorant employed in the present invention.

Examples of blue colorants include phthalocyanine type C.I. Pigment Blue 15-3 and indanthrone type C.I. Pigment Blue 60; examples of red colorants include quinacridone type C.I. Pigment Red 122, azo type C.I. Pigment Red 22, C.I. Pigment Red 48:1, C.I. Pigment Red 48:3, and C.I. Pigment Red 57:1; and yellow colorants include azo type C.I. Pigment Yellow 12, C.I. Pigment Yellow 13, C.I. Pigment Yellow 14, C.I. Pigment Yellow 17, C.I. Pigment Yellow 97, C.I. Pigment Yellow 155, isoindolinone type C.I. Pigment Yellow 110, benzimidazolone type C.I. Pigment Yellow 151, C.I. Pigment Yellow 154, and C.I. Pigment Yellow 180.

In the present invention, a known charge control agent can be employed if necessary. Examples of positive charge control agents include nigrosine dyes, modified nigrosine dyes, triphenyl methane dyes, quaternary ammonium salts, and resins having quaternary ammonium groups and/or amino groups. Examples of negative charge control agents include trimethylethane dye, metal salt or complex of salicylic acid, metal salt or complex of benzylic acid, copper phthalocyanine, perylene, quinacridone, metal salt or complex of azo compound, phenol condensate of the calixarene type, cyclic polysaccharides, and resin having carboxyl groups and/or sulfonyl groups.

Examples of preferred positive charge control agents which can be employed in the present invention include nigrosine dyes such as "NIGROSINE BASE EX", "OIL BLACK BS", "BONTRON N-01" and "BONTRON N-07" (manufactured by Orient Chemical); modified nigrosine dyes such as "BONTRON N-04" and "BONTRON N-21" (manufactured by Orient Chemical); and "CHUO-3" (manufactured by CHUO GOUSEI KAGAKU CO., LTD.). Examples of trimethylethane dyes include "OIL BLUE" (manufactured by Orient Chemical) and "COPY BLUE PR" (manufactured by Clariant Corp.).

In the toner for electrostatic image development of the present invention, quaternary ammonium salt compounds can also be employed. Examples of the quaternary ammonium salt compounds include compounds represented by the following formulas 1 to 3.

(Formula 1)

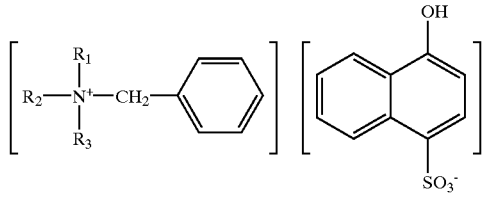

wherein $R_1$, $R_2$, and $R_3$ each independently represents an alkyl group having 1 to 10 carbon atoms.

(Formula 2)

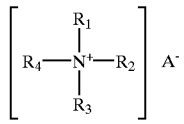

wherein $R_1$, $R_2$, $R_3$, and $R_4$ each independently represents a hydrogen atom, an alkyl or alkenyl group having 1 to 22 carbon atoms, a non-substituted or substituted aromatic group having 1 to 20 carbon atoms, or an aralkyl group having 7 to 20 carbon atoms; and $A^{31}$ represents a molybdate anion or a tungstate anion, or a heteropoly-acid anion having a molybdenum or tungsten atom.

(Formula 3)

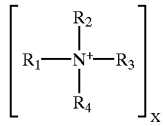

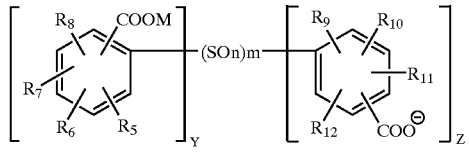

wherein m represents an integer of 1 to 3; n represents an integer of 0 to 2; X and Z represent 1 or 2, Y represents 0 or 1; Y=1 and Z=1 when X=1; Y=0 and Z=2 when X=2; M represents a hydrogen atom or a monovalent metal ion; $R_1$, $R_2$, $R_3$, and $R_4$ represent a hydrogen atom, a straight-chain or branched saturated or unsaturated alkyl group having 1 to 30 carbon atoms, an oxyethyl group represented by the formula $(—CH_2CH_2O)_p—R$, provided that R represents a hydrogen atom, or an alkyl or acyl group having 1 to 4 carbon atoms, and p represents an integer of 1 to 10, a monocyclic or polycyclic aliphatic group having 5 to 12 carbon atoms, or a-monocyclic or polycyclic aromatic group; $R_5$ to $R_{12}$ represent a hydrogen atom, a straight-chain or branched saturated or unsaturated alkyl group having 1 to 30 carbon atoms, an alkoxyl group having 1 to 4 carbon atoms, or a polyoxyalkylene group represented by the formula $[(—C_qH_{2q}—O)_r—R$ (provided that R represents a hydrogen atom, or an alkyl or acyl group having 1 to 4 carbon atoms; q represents an integer of 2 to 5; and r represents an integer of 1 to 10)].

More specifically, the following compounds are listed.

Compound (1-1)

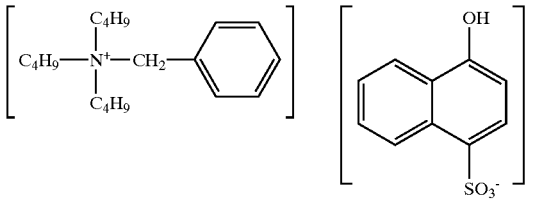

Compound (2-1)

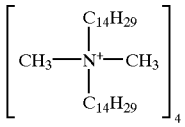

(Compound 2-2)

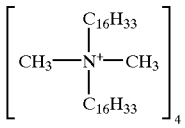

Compound (2-3)

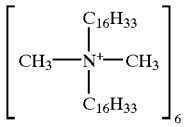

Compound (3-1)

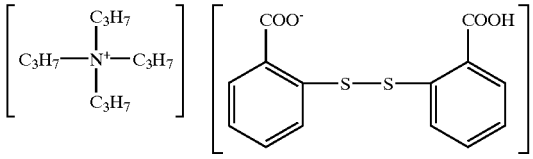

Examples of preferred negative charge control agents which can be employed in the present invention include metal complex of azo compound, metal complex of salicylic acid, metal complex of benzilic acid, and a compound represented by the following general formula 4.

(Formula 4)

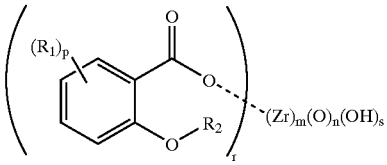

wherein $R_1$ represents an alkyl group, an alkenyl group, an alkoxy group, an aryl group which may have a substituent, an amino group which may have a substituent, a hydroxyl group, a carboxyl group, a halogen atom, or a hydrogen atom; $R_2$ represents a hydrogen atom or alkyl group; m represents an integer of 1 to 20; n represents an integer of 0 to 20; p represents an integer of 0 to 4; r represents an integer of 1 to 20; and s represents an integer of 0 to 20.

Specific examples of the compound represented by formula 4 include the following compound (4-1).

Compound (4-1)

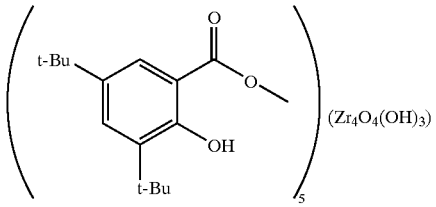

The metal complex of benzilic acid which can be preferably employed in the present invention is a compound represented by the following formula 5.

(Formula 5)

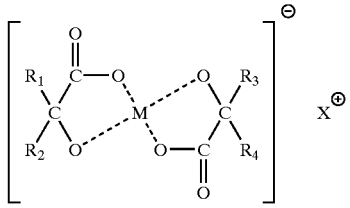

wherein $R_1$ and $R_4$ represent a hydrogen atom, an alkyl group, or a substituted or non-substituted aromatic ring (also including a fused ring); $R_2$ and $R_3$ represent a substituted or non-substituted aromatic ring (also including a fused ring); M represents a trivalent metal selected from B, Al, Fe, Ti, Co, and Cr; and $X^+$ represents a cation.

Specific examples of the compound of formula 5 include the following compound (5-1).

Compound (5-1)

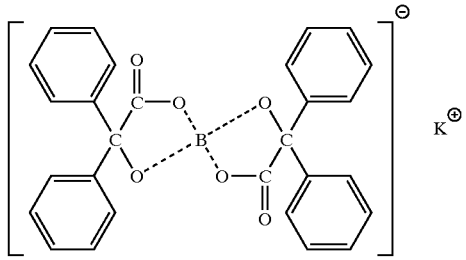

Examples of the metal complex of the azo compound which can be preferably employed in the present invention include the following compounds (6-1) to (6-3).

Compound (6-1)

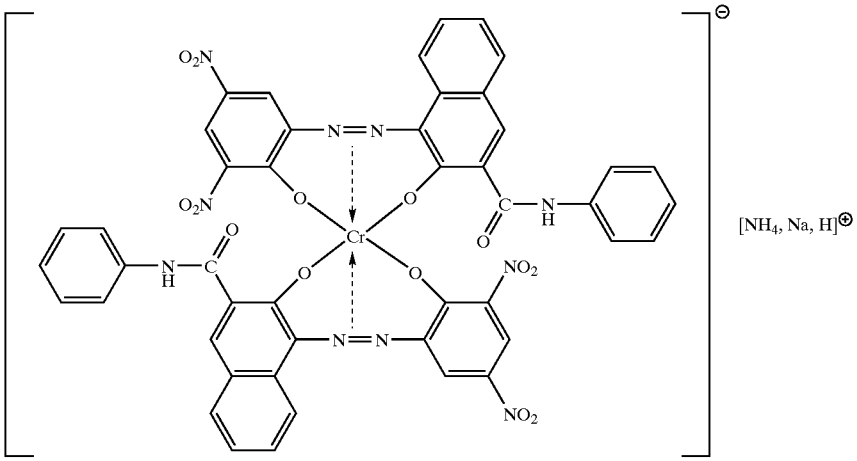

Compound (6-2)

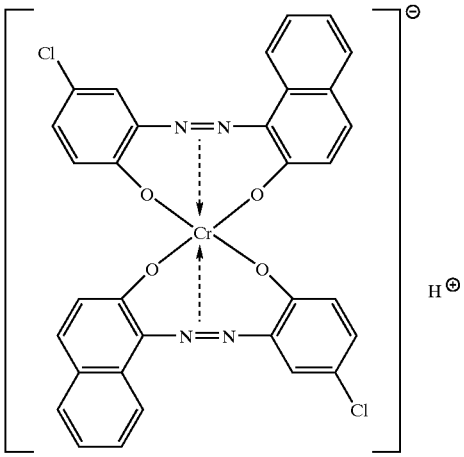

Compound (6-3)

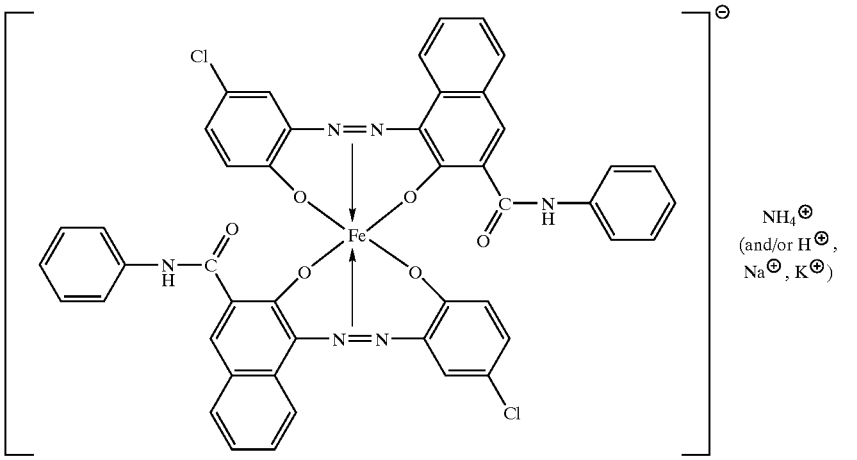

The cation in compound (6-3) is $NH_4^+$, $H^+$, $Na^+$, $K^+$, or a mixture thereof.

In the present invention, one or more of the charge control agents described above are preferably employed. Among these charge control agents, a black charge control agent is preferably employed. Examples of the black positive charge control agent include nigrosine dyes, modified nigrosine dyes, and triphenylmethane dyes. Among these dyes, modified nigrosine dyes modified with rosin or maleic acid are particularly preferably employed to improve the dispersibility in the resin because the proportion of the number of particles having charges in the opposite polarity and the number of insufficiently charged particles decreases, and thus surface contamination and toner dispersion are reduced, resulting in good image quality. Examples of the black negative charge control agent include metal salt or complex of the above azo compound. When employing these black charge control agents in combination with the black colorant employed in the present invention, the blackness of the toner for electrostatic image development of the present invention can be enhanced. The use of the black charge control agent can reduce the amount of the black colorant employed in the present invention. As a result, the true specific gravity of the toner can be lowered and toner dispersion can be prevented. When employing the black charge control agent, the amount of the black colorant employed in the present invention is preferably within a range from 3 to 12 parts by weight, and more preferably from 5 to 9 parts by weight, based on 100 parts by weight of the toner.

The above charge control agents may be employed alone or in combination, but are preferably employed in combination with one or more compounds selected from nigrosine dyes, modified nigrosine dyes, and triphenylmethane dyes, and a compound having a quaternary ammonium salt structure. As the compound having a quaternary ammonium salt structure, compounds represented by formulas 1 to 3 are preferably employed.

When the binder resin contains the charge control agent in an amount within a range from 0.3 to 15 parts by weight, and preferably from 0.5 to 5 parts by weight, based on the binder resin, good chargeability can be obtained.

The binder resin can be employed in the toner for electrostatic image development of the present invention without any limitation as long as the object of the present invention is not impaired. Specific examples thereof include vinyl copolymer resin such as polystyrene resin, styrene-(meth) acrylate ester copolymer resin or styrene-conjugated diene copolymer resin, polyester resin, epoxy resin, butyral resin, xylene resin, cumarone-indene resin, and a hybrid resin as a combination of the above resins. Among these resins, vinyl copolymer resin, polyester resin and epoxy resin are preferred, and polyester resin, is particularly preferred because of its good balance between fixation properties, anti-offset properties, and transparency.

The polyester resin which is preferably employed in the present invention is obtained by dehydration condensation of:

(A) a dibasic or higher polybasic acid, an acid anhydride thereof, or a lower alkyl ester of the dibasic or higher polybasic acid, and (B) a dihydric or higher polyhydric alcohol by a conventional method.

Examples of the divalent or polyvalent polybasic acid or acid anhydride include dicarboxylic acids or acid anhydrides or derivatives thereof such as phthalic anhydride, terephthalic acid, isophthalic acid, orthophthalic acid, naphthalenedicarboxylic acid, adipic acid, maleic acid, maleic anhydride, fumaric acid, itaconic acid, citraconic acid, hexahydrophthalic anhydride, tetrahydrophthalic anhydride, cyclohexanedicarboxylic acid, succinic acid, malonic acid, glutaric acid, azelaic acid, and sebacic acid. Examples of the trivalent or higher polyvalent polybasic acid and/or acid anhydride include trimellitic acid, trimellitic anhydride, pyromellitic acid, and pyromellitic anhydride. Examples of the low alkyl ester of the divalent or polyvalent polybasic acid include those wherein an alkyl residue preferably has 1 to 6 carbon atoms, and more preferably 1 to 4 carbon atoms. The low alkyl ester can be obtained by transesterifying the divalent or polyvalent polybasic acid or acid anhydride thereof with a lower alcohol. Terephthalic acid, isophthalic acid, orthophthalic acid, naphthalenedicarboxylic acid, maleic acid, maleic anhydride and fumaric acid are preferred among the polybasic acids.

Examples of the dihydric or higher polyhydric alcohol include the following compounds. Examples of the dihydric aliphatic alcohol include:

(a) ethylene glycol, polyethylene glycol, propylene glycol, tripropylene glycol, butanediol, pentanediol, hexanediol, neopentyl glycol, cyclohexanedimethanol, ethylene oxide-propylene oxide random copolymer diol, and ethylene oxide-tetrahydrofuran copolymer diol.

Examples of the dihydric aromatic diol include the following compounds (b) as alkylene oxides of bisphenol A:

(b) polyoxyethylene-(2.2)-2,2-bis(4-hydroxyphenyl) propane,
polyoxyethylene-(2.0)-2,2-bis(4-hydroxyphenyl)propane,
polyoxypropylene-(2.0)-2,2-bis(4-hydroxyphenyl)propane,
polyoxypropylene-(2.2)-polyoxyethylene-(2.0)-2,2-bis(4-hydroxyphenyl)propane,
polyoxypropylene-(6)-2,2-bis(4-hydroxyphenyl)propane,
polyoxypropylene-(2.2)-2,2-bis(4-hydroxyphenyl)propane,
polyoxypropylene-(2.4)-2,2-bis(4-hydroxyphenyl)propane,
polyoxypropylene-(3.3 )-2,2-bis(4-hydroxyphenyl)propane, and derivatives thereof.

Examples of the trihydric or higher polyhydric alcohol include:

(c) trihydric or polyhydric alcohols such as sorbitol, 1,2,3,6-hexanetetraol, 1,4-sorbitan, pentaerythritol, 1,2,4-butanetriol, 1,2,5-pentanetriol, glycerin, 2-methylpropanetriol, 2-methyl-1,2,4-butanetriol, trimethylolethane, trimethylolpropane, and 1,3,5-trimethylolbenzene; and ethylene glycol diglycidyl ether, hydroquinone diglycidyl ether, N,N-diglycidylaniline, glycerin triglycidyl ether, trimethylolpropane triglycidyl ether, trimethylolethane triglycidyl ether, pentaerythritol tetraglycidyl ether, neopentyl glycol diglycidyl ether, bisphenol A epoxy resin, bisphenol F epoxy resin, cresol novolak epoxy resin, phenol novolak epoxy resin, polymer or copolymer of vinyl compound having epoxy groups, epoxidated resorcinol-acetone condensate, partially epoxidated polybutadiene, and semi-dry or dry fatty acid ester epoxy compound.

As the polyester reisin in the present invention, a polyester resin obtained by the reaction of reactants comprising a dibasic acid, an acid anhydride thereof, or a lower alkyl ester of the dibasic acid and a dihydric fatty alcohol is preferably employed. A crosslinked or branched polyester resin obtained by the reaction of reactants comprising a dibasic acid, an acid anhydride thereof, or a lower alkyl ester of the dibasic acid and a dihydric fatty alcohol, as well as the trivalent or higher polybasic acid compound or the trihydric or higher alcohol described in component (c) is more preferably employed. In that case, when employing compound (b) as the polyhydric alcohol, the amount is preferably within a range from 0 to 30 mol %, and more preferably from 0 to 10 mol %, based on the entire alcohol component. It is particularly preferred that compound (b) is not employed at all.

The polyester resin employed in the present invention can be obtained by a dehydration condensation reaction or transesterification reaction of the above raw material components in the presence of a catalyst. The reaction temperature and reaction time are not specifically limited, but are commonly 150 to 300° C. and 2 to 24 hours. Examples of the catalyst employed during the reaction include zinc oxide, stannous oxide, dibutyltin oxide, and dibutyltin dilaurate. The mixing ratio (molar ratio) of the polybasic acid compound to the diol compound is preferably from 8/10 to 10/8, and particularly preferably from 9/10 to 10/9. When the divalent polybasic acid compound is reacted with the diol component, a straight-chain polyester resin can be obtained. When the divalent, trivalent, or polyvalent polybasic acid compound is reacted with the polyhydric alcohol, a branched or network polyester resin can be obtained. These polyester resins thus obtained may be employed alone, or employed in combination with a plurality of polyester resins so that the desired performances can be obtained.

When employing the polyester resin as the binder resin of the toner for electrostatic image development of the present invention, the most preferred polyester is that of a straight-chain polyester resin, which is obtained by reacting a dibasic acid, an acid anhydride, or a low alkyl ester of the dibasic or higher polybasic acid with a dihydric aliphatic alcohol without employing compound (b) as the polyhydric alcohol component, used in combination with a crosslinked polyester resin, which is obtained by reacting a dibasic acid, an acid anhydride thereof, or a lower alkyl ester of the dibasic or higher polybasic acid with a dibasic aliphatic alcohol and an epoxy resin without employing compound (b) as the polyhydric alcohol component. The toner obtained by employing such a resin as the binder resin has good fixation properties at low temperatures and is also superior in offset properties at high temperatures.

The softening point of the binder resin employed in the present invention is preferably within a range from 90 to 180° C., and more preferably from 95 to 160° C. When the softening point is lower than 90° C., offset at high temperatures is likely to occur. On the other hand, when it is higher than 180° C., the fixation properties at low temperatures are likely to be lowered.

The softening point of the resin in the present invention is defined by the temperature T1/2 as measured by a constant load extrusion type capillary rheometer, Flow Tester CFT-500 manufactured by Shimadzu Corporation. The measurement by the flow tester was conducted under the conditions of a piston cross-sectional area of 1 $cm^2$, a cylinder pressure of 0.98 MPa, a die pore diameter of 1 mm, a die length of 1 mm, a measuring initiation temperature of 50° C., a heating rate of 6° C./min, and a sample weight of 1.5 g.

Furthermore, the glass transition temperature of the binder resin is preferably 50° C. or higher, and particularly preferably 55° C. or higher. When Tg is 50° C. or lower, a blocking phenomenon (thermal aggregation) is likely to occur when the toner is stored, transported, or exposed to high temperatures in a developing apparatus of a machine. As used herein, the term glass transition temperature is defined by an extrapolated glass transition initiation temperature obtained by a measurement in accordance with JIS K7121. In the measurement, DSC-60 manufactured by Shimadzu Corporation was employed.

The acid value is preferably within a range from 1 to 30 mg KOH/g, and more preferably from 1 to 20 mg KOH/g. The hydroxyl value is preferably within a range from 10 to 100 mg KOH/g, and more preferably from 10 to 60 mg KOH/g. When the acid value and hydroxyl value are within the above ranges, the resulting toner has good moisture resistance, which is preferred.

The releasing agent employed in the toner of the present invention for electrostatic image development includes various known releasing agents, for example, polyolefin waxes and/or modified polyolefin waxes such as polypropylene wax, polyethylene wax, polyamide wax, and Fischer-Tropsch wax; and waxes containing a higher fatty acid ester compound and/or an aliphatic alcohol compound.

Among the waxes containing a higher fatty acid ester compound and/or an aliphatic alcohol compound, waxes originating in natural products such as carnauba wax, rice wax, wax from scale insects, and Montan ester wax; synthetic ester waxes such as tetrabehenate ester of pentaerythritol; and alcohol waxes such as higher alcohol wax obtained by oxidizing Fischer-Tropsch wax, for example, are particularly preferred.

The releasing agent is preferably selected according to the binder resin employed in combination. If a releasing agent having poor dispersibility to the binder resin is used, the releasing agent is likely to be exposed on the surface of the toner particles and the fluidity of the toner is likely to be lowered. During the grinding step in the manufacturing process of the toner, the releasing agent is likely to be eliminated and the amount of the releasing agent included in the toner is reduced, and thus fixation/offset properties are likely to be lowered. Furthermore, in the step of developing the toner, the eliminated releasing agent is likely to cause surface contamination and dispersion, and the image quality is likely to be lowered. If dispersion of the releasing agent in the binder resin proceeds excessively or the releasing agent is compatible with the resin, the fixation/offset properties are likely to be lowered. For these reasons, a releasing agent, which disperses properly in the binder resin, is preferably selected, and the particle diameter of the releasing agent dispersed in the binder resin is preferably within a range from 0.01 to 5 $\mu$m, and more preferably from 0.1 to 3 $\mu$m.

Regarding a preferred combination of the binder resin and the releasing agent employed in the present invention, when employing a polyester resin or an epoxy resin as the binder resin, a wax containing a higher fatty acid ester compound and/or a higher aliphatic alcohol compound is employed as the releasing agent. When employing a vinyl copolymer as the binder resin, a polyolefin wax and/or a modified polyolefin wax are employed.

The melting point (dropping point, softening temperature) of the releasing agent is preferably within a range from 60 to 180° C., and more preferably from 65 to 170° C. When the melting point is too low, aggregation is likely to occur during storage, and the fluidity of the toner is likely to be lowered. On the other hand, when the melting point is too high, it is difficult to melt the toner during the image fixing step, and a sufficient releasing effect is hardly exhibited.

Since the releasing agent adheres to charging members such as a blade and carrier causing unstable chargeability and deterioration of image quality, a larger hardness is better in view of suppression of adhesion. The penetration at 25° C. is preferably 5 or less, and particularly preferably 2 or less.

Natural wax, synthetic ester wax, and alcohol wax have an acid value of about 2 to 40 in terms of a catalog value due to structure or free acid. For the same reason as in the case of the resin, a lower value is better.

These releasing agents may be employed alone or in combination and good fixation/offset properties are obtained by mixing the binder resin with the releasing agent in an amount within a range from 0.1 to 15 parts by weight, and preferably 1 to 5 parts by weight based on 100 parts by weight of the binder resin. When the amount is less than 0.1 parts by weight, the anti-offset properties are likely to be impaired. On the other hand, when the amount is more than 15 parts by weight, the fluidity of the toner is likely to be lowered. Adhesion to the charging members is likely to exert an adverse influence on the charge characteristics of the toner.

The toner for electrostatic image development of the present invention can contain additives other than binder resins, releasing agents, charge control agents, and colorants. For example, metallic soaps and zinc stearate may be employed as lubricants, and cerium oxide and silicon carbide may be employed as abrasives.

The toner for electrostatic image development of the present invention can be obtained by very common manufacturing methods, and does not require special manufacturing methods. For example, it is possible to obtain this toner by first melting and kneading the resin, the colorant, and the charge control agent at a temperature above the melting point of the resin (or the softening point), and then pulverizing and fractionating this. Concretely, for example, the resin described above, the colorant, the releasing agent, and the charge control agent are uniformly mixed beforehand employing a Henschel mixer before melt-kneading. The conditions of the mixing are not specifically limited, but the mixing may be carried out in several steps to attain the desired uniformity. A flushing procedure may be carried out in advance so that the colorant and/or charge control agent is uniformly dispersed in the resin, or alternatively, this may be mixed and kneaded at high concentrations with the resin to provide a master batch.

The above mixture is kneaded by means of a kneading process employing two rollers, three rollers, a pressure kneader, or a twin-screw extruder. At this time, it is sufficient if the colorant and the like are uniformly dispersed in the resin, such that the melting and kneading conditions are not particularly restricted; however, these are commonly within a range of 80–180° C. and from 30 seconds to 2 hours.

If necessary, the kneaded mixture is crushed for the purpose of reducing the burden during the pulverizing step and improving the pulverizing efficiency. The apparatus employed for crushing and the conditions therefore are not specifically limited, but the kneaded mixture is generally crushed to a size of 3 mm mesh or less employing a Rotoplex or pulverizer.

Next, pulverizing is carried out in a mechanical pulverizer such as a turbo mill or Criptron; or an air type pulverizer such as a volute type jet mill, counter jet mill, or collision plate type jet mill, and separated by means of an air separator. The apparatus for pulverization and separation as well as the conditions thereof may be selected and set to obtain the desired particle diameter, particle size distribution, and particle form.

Examples of other methods of producing the toner for electrostatic image development of the present invention include phase reversal emulsion methods as disclosed in U.S. Pat. No. 5,885,743 and U.S. Pat. No. 6,017,670. The phase reversal emulsion method is a method of producing toner particles, which comprises adding an aqueous medium (water or a liquid medium containing water as a main component) to a mixture of a binder resin, other raw materials, and an organic solvent to form a water-in-oil discontinuous phase, further adding water to thereby convert it into an oil-in-water discontinuous phase, further adding an aqueous medium to form a suspension wherein the mixture floats as particles (liquid droplets) in the aqueous medium, and removing the organic solvent.

The volume-average particle diameter of the particles which form the toner is not particularly limited; however, it is preferably set within a range of 5–15 $\mu$m.

In the present invention, various additives (referred to as external additives) can be employed to improve the surface of the toner base material, such as an increase in the fluidity of the toner and an improvement in the charge characteristics thereof. Possible materials employed in the present invention include, for example, inorganic microparticles such as silicon dioxide, titanium oxide, and alumina as well as the products resulting when these are subjected to a surface treatment employing a hydrophobic treating agent such as silicone oil, and fine resin powders.

Among these, silicon dioxide, the surface of which has been subjected to a hydrophobic treatment by means of various polyorganosiloxanes or silane coupling agents, is particularly advantageously employed as the external additive of the positive charge control agent.

These products are commercially available under the following trade names, for example.

AEROSIL: RA200HS and RA200H (manufactured by Nippon Aerosil)

WACKER: H2050, HVK2150, HDK H30TA, H13TA and H05TA (manufactured by Wacker Chemicals East Asia)

CABOSIL: TG820F (manufactured by Cabot Specialty Chemicals Inc.)

The titanium oxide may be hydrophilic titanium oxide or hydrophobic titanium oxide prepared by surface-treating with octyl silane. These products are commercially available under the following trade names, for example.

Titanium oxide T805 (manufactured by Degussa), titanium oxide P25 (manufactured by Nippon Aerosil) and titanium oxide JMT-150ANO (manufactured by TAYCA CORPORATION).

The alumina includes aluminum oxide C (manufactured by Degussa).

The particle diameter of these external additives is preferably ⅓ or smaller, and particularly preferably 1/10 or smaller, the diameter of the toner. Two or more kinds of external additives, each having a different average particle diameter, may be used in combination. The amount of silica is usually within a range from 0.05 to 5% by weight, and preferably from 0.1 to 3% by weight, with respect to the toner.

When employing the toner for electrostatic image development of the present invention in the two-component developing method, the following carrier can be employed. The core agent of the carrier employed in the present invention may be an iron powder, a magnetite, or a ferrite which is commonly employed in the two-component developing method; among these, ferrite or magnetite carriers, which have a low true specific gravity, a high resistance, superior environmental stability, and which are easy to make spherical and thus have good flow characteristics, which are preferably employed. The shape of the core agent may be spherical or unspecified. The average particle diameter is generally within a range from 10 to 500 $\mu$m; however, in printing high-resolution images, a range of 30–100 $\mu$m is preferable.

Furthermore, examples of the coating resin for coating the core agent include polyethylene, polypropylene, polystyrene, polyacrylonitrile, polyvinyl acetate, polyvinyl alcohol, polyvinyl butyral, polyvinyl chloride, polyvinyl carbazole, polyvinyl ether, polyvinylketone, vinyl chloride-vinyl acetate copolymer, styrene-acrylic copolymer, straight silicone resin comprising organosiloxane bonds or derivatives thereof, fluorine resin, (meth)acrylate resin, polyester, polyurethane, polycarbonate, phenol resin, amino resin, melamine resin, benzoguanamine resin, urea resin, amide resin, epoxy resin, and acrylic polyol resin. Among these, silicone resin, fluorine resin, and (meth)acrylate resin have superior charge stability and coating strength and are preferably employed. In other words, in the present invention, it is preferable that the resin coated carrier be a resin coated magnetic carrier which contains ferrite or magnetite as a core agent and is coated with one or more resins selected from the group consisting of silicone resin, fluorine resin, and (meth)acrylate resin.

The non-magnetic one component development method includes, for example, a contact type non-magnetic one-component development method comprising developing by contacting a development sleeve supporting a toner with a photoconductor drum having an electrostatic latent image, and a non-contact type development method comprising developing by transferring a toner to a development sleeve over a photoconductor. The toner for electrostatic image development of the present invention can be preferably used in either of both methods.

EXAMPLES

The following Examples further illustrate the present invention in detail.

However, the present invention is not limited to the following Examples.

Colorant 1

Fine black powders comprising titanium dioxide ($TiO_2$: Titanium Dioxide) particles and a complex oxide (Iron Titanium spinel) having a spinel structure represented by $Fe_2TiO_4$ formed on the surface of the titanium dioxide particles.

Physical Properties

Primary particle diameter: 0.25 μm, Specific surface area: 5.1 $m^2/g$, pH: 6.6,Oil absorption amount: 31 g/100 g, Moisture: 0.1% by weight, Bulk density: 0.40 g/ml, Resistivity: 9440 Ω·cm, Magnetic characteristics (VSM 397.9 kA/m)

Hc: 23.2 kA/m, σs: 9.8 $Am^2/kg$, σr: 2.7 $Am^2/kg$

True specific gravity: 5.98

Chromaticity

Minimum reflectance within entire wavelength range: 2.8% (λ=380 nm)

Maximum reflectance within entire wavelength range: 5.4% (λ=720 nm)

Difference between maximum reflectance and minimum reflectance: 2.6%

L*: 19.8 a*: 1.75 b*: 1.23

Comparative Colorant 1

After dispersing 100 g of granular magnetite particle powders having an average particle diameter of 0.2 μm and a magnetization value of 85.0 emu/g in an aqueous solution containing 0.26 mol of $TiOSO_4$, the mixed solution was neutralized by adding NaOH to deposit a hydroxide of Ti on the surface of the particles at a pH of 8, followed by filtration and further drying. After calcining under an $N_2$ gas flow at 750° C. for 120 minutes, the calcined hydroxide was ground to obtain a black particle powder (Comparative Colorant 1). The black particle powder had a particle diameter of 0.25 μm. The results of X-ray diffraction revealed that the particles are made of a mixed composition of $Fe_2TiO_3$ and a $Fe_2O_3$—$FeTiO_3$ solid solution.

The magnetic characteristics and true specific gravity of Comparative Colorant 1 are as follows.

Magnetic characteristics (VSM 397.9 kA/m)

Hc: 9.3 kA/m, σs: 24.8 $Am^2/kg$, σr: 3.5 $Am^2/kg$

True specific gravity: 7.23

Comparative Colorant 2

EPT-1000; black iron oxide (magnetite: manufactured by TODA KOGYO CORP.)

Magnetic characteristics (VSM 397.9 kA/m)

Hc: 9.3 kA/m, σs: 82.4 $Am^2/kg$, σr: 10.5 $Am^2/kg$

True specific gravity: 8.88

Synthesis Examples of the binder resin used in the production of the toner are shown below. Each of the resins obtained in the respective Synthesis Examples was dipped in tetrahydrofuran (THF), and after standing for 12 hours, the resulting solution was filtered. The molecular weight of the resulting THF soluble fraction was measured. In the analysis, gel permeation chromatography (GPC) was employed and the molecular weight was calculated from the calibration curve made by standard polystyrene.

GPC apparatus: HLC-8120GPC, manufactured by TOSOH CORPORATION

Column: TSK Guard Column Super H-H TSK-GEL Super HM-M, three coupling, manufactured by TOSOH CORPORATION Concentration: 0.5% by weight Flow rate: 1.0 ml/min The THF insoluble fraction was determined in the following manner: after weighing 1 g of a sample powder on cylindrical filter paper, the sample powder was refluxed by a Soxhlet's extractor employing THF as a solvent for 8 hours, and the THF insoluble fraction was calculated from the residue on the filter paper.

The acid value was measured in accordance with JIS K6901, and Tg was measured in accordance with JIS K7121.

Resin 1

Terephthalic acid: 664 parts by weight

Ethylene glycol: 75 parts by weight

Polyoxypropylene-(2.2)-2.2-bis(4-hydroxyphenyl)propane: 700 parts by weight

Trimethylolpropane: 80 parts by weight

Tetrabutyl titanate: 3 parts by weight

The above materials were charged in a four-necked flask equipped with a stirrer, a condenser, and a thermometer, and after adding 4 parts by weight of tetrabutyl titanate under a nitrogen gas flow, the reaction was conducted at 240° C. at normal pressure for 10 hours while removing water produced by dehydration condensation. After gradually reducing the pressure, the reaction was continued at 5 mmHg. The reaction was monitored based on the softening point, and the reaction was completed at the time when the softening point reached 145° C. The resulting polyester resin exhibited Mn of 5,450, Mw of 152,200, a softening point of 147° C., an acid value of 5.8, Tg of 63° C. as measured by the DSC method, and a THF insoluble fraction of 3%.

Resin 2

Terephthalic acid: 664 parts by weight

Propylene glycol: 152 parts by weight

Cyclohexane dimethanol: 145 parts by weight

Neopentyl glycol: 150 parts by weight

The above materials were charged in a 2-liter four-necked flask equipped with a stirrer, a condenser, and a thermometer, and after adding 4 parts by weight of tetrabutyl titanate under a nitrogen gas flow, the reaction was conducted at 200° C. at normal pressure for 20 hours while removing water produced by dehydration condensation. After gradually reducing the pressure, the reaction was continued at 5 mmHg. The reaction was monitored based on the softening point as measured in accordance with ASTM E28–517, and the reaction was completed at the time when the softening point reached 90° C. The resulting polyester resin exhibited Mn of 2,520, Mw of 6,200, a softening point of 95° C., an acid value of 6.8, and Tg of 53° C. as measured by the DSC method.

Resin 3

Terephthalic acid: 664 parts by weight

Neopentyl glycol: 120 parts by weight

Ethylene glycol: 150 parts by weight
Propylene glycol: 61 parts by weight
EPICRON 830 (manufactured by DAINIPPON INK & CHEMICALS Co., Ltd., bisphenol
F epoxy resin): 19.3 parts by weight
CARDULA E: 20 parts by weight The above materials were charged in a 2-liter four-necked flask equipped with a stirrer, a condenser, and a thermometer, and after adding 4 g of tetrabutyl titanate under a nitrogen gas flow, the reaction was conducted at 240° C. at normal pressure for 12 hours while removing water produced by dehydration condensation. After gradually reducing the pressure, the reaction was continued at 30 mmHg. The reaction was monitored based on the softening point as measured in accordance with ASTM E28–517, and the reaction was completed at the time when the softening point reached 200° C. The resulting polyester resin exhibited Mn of 52,800, Mw of 165,100, a THF insoluble fraction of 7.4%, a softening point of 203° C., an acid value of 9.3, and Tg of 67.2° C.

Resin 4

Isophthalic acid: 116 parts by weight
Terephthalic acid: 166 parts by weight
Trimellitic anhydride: 38 parts by weight
Diethylene glycol: 26 parts by weight
Neopentyl glycol: 104 parts by weight
Ethylene glycol: 50 parts by weight
Tetrabutyl titanate: 2.5 parts by weight The above materials were charged in a 2-liter four-necked glass flask equipped with a thermometer, a stirring rod, and a nitrogen introducing tube, and then reacted in a mantle heater under a nitrogen gas flow at 240° C. at normal pressure for 10 hours. After gradually reducing the pressure, the reaction was continued at 10 mmHg. The reaction was monitored based on the softening point as measured in accordance with ASTM E28–517, and the reaction was completed at the time when the softening point reached 148° C. The resulting polyester resin was a colorless solid and exhibited an acid value of 4, Tg of 72° C., and a softening point of 151° C.

Resin 5

Styrene: 380 parts by weight
Butyl methacrylate: 120 parts by weight
Divinylbenzene: 10 parts by weight
Benzoyl peroxide: 5 parts by weight In a 2 volume of a four-necked round-bottom flask equipped with a thermometer, a glass air current introducing tube, a stirring rod with a vacuum-resistant seal device, and a water cooling Dimroth condenser, 500 parts of xylene and the entire amount of the monomers and the initiator were charged. After the atmosphere in the reaction vessel was replaced by an inert atmosphere by introducing a nitrogen gas through the glass air current introducing tube, the contents were gradually heated t p o 75° C. by a mantle heater with a slide transformer. The reaction was conducted while maintaining at a temperature of 65 to 80° C., and then the polymerization was completed by raising the temperature to 130° C. so as to complete the reaction after 10 to 12 hours. After removing the water cooling condenser and the glass air current introducing tube from the flask, the flask was equipped with a capillary tube for vacuum distillation and a Cliasen fractionating column. A thermometer and a water cooling Liebig condenser were connected to the Cliasen fractionating column, and an exhaust port of the condenser was connected to a Kjeldahl flask via a suction adapter. The suction adapter was connected to a vacuum pump via a manometer and a trap via a vacuum rubber tube, and thus preparation for vacuum distillation was completed. When the mantle heater was heated and the vacuum pump was operated to evacuate to 20 mmHg while sufficiently stirring the contents, xylene or the unreacted monomer began to distil at a liquid temperature of 75° C. and a distillation temperature of 38° C. Finally, the solvent was completely removed by evacuating to 0.5 mmHg at a liquid temperature of 180° C. The resulting polymer (hereinafter referred to as Polymer (a)) was spread over a stainless steel pan in a molten state at a high temperature, and then ground after cooling to room temperature.

The resulting polymer exhibited a softening point of 145° C., Tg of 61° C., Mn of 8,000, and Mw of 21,000.

Example 1

| Production of toner | |
|---|---|
| Resin 1 | 78 parts by weight |
| Colorant 1 | 18 parts by weight |
| Compound (3-1) | 1 part by weight |
| Purified carnauba wax powder, type 1 (manufactured by S. KATO & CO.) | 3 parts by weight |

Employing a Henschel mixer, a mixture of the above raw materials was prepared, and the mixture was temporarily stored in a hopper. Then, the mixture was kneaded by a twin-screw melt-kneader. The kneaded mixture thus obtained was ground by a mechanical grinder and then fractionated to obtain a Raw Toner 1 .having a volume-average particle diameter of 9.8 μm.

| | |
|---|---|
| Raw Toner 1 | 100 parts by weight |
| HVK2150 | 0.5 parts by weight |

After mixing the resulting Raw Toner 1 with the above hydrophobic silica by means of a Henschel mixer, the mixture was sifted to obtain the toner of Example 1.

In the same manner as in Example 1, the toners of Examples 2 to 10 and Comparative Examples 1 to 3 were produced according to the formulations shown in Table 1.

TABLE 1

| | Resin | Colorant | Wax | Charge control agent | Average particle size |
|---|---|---|---|---|---|
| Example 1 | Resin 1<br>78 parts by weight | Colorant 1<br>18 parts by weight | Carnauba<br>3 parts by weight | Compound (3-1)<br>1 part by weight | 9.8 μm |
| Example 2 | Resin 2<br>43 parts by weight<br>Resin 3<br>43 parts by weight | Colorant 1<br>8 parts by weight | Carnauba<br>3 parts by weight | N-04<br>2 parts by weight<br>Compound (2-1)<br>1 part by weight | 10.0 μm |

TABLE 1-continued

| | Resin | Colorant | Wax | Charge control agent | Average particle size |
|---|---|---|---|---|---|
| Example 3 | Resin 2<br>43 parts by weight<br>Resin 3<br>43 parts by weight | Colorant 1<br>8 parts by weight | Carnauba<br>3 parts by weight | PR<br>2 parts by weight<br>Compound (2-1)<br>1 part by weight | 10.3 μm |
| Example 4 | Resin 4<br>87 parts by weight | Colorant 1<br>8 parts by weight | Carnauba<br>3 parts by weight | N-04<br>2 parts by weight | 9.9 μm |
| Example 5 | Resin 4<br>87 parts by weight | Colorant 1<br>8 parts by weight | 550P<br>3 parts by weight | N-04<br>2 parts by weight | 9.8 μm |
| Example 6 | Epoxy resin<br>87 parts by weight | Colorant 1<br>8 parts by weight | PETB<br>3 parts by weight | PR<br>2 parts by weight | 9.7 μm |
| Example 7 | Resin 5<br>86 parts by weight | Colorant 1<br>8 parts by weight | 550P<br>3 parts by weight | N-04<br>2 parts by weight<br>Compound (2-1)<br>1 part by weight | 10.1 μm |
| Example 8 | Resin 5<br>86 parts by weight | Colorant 1<br>8 parts by weight | Carnauba<br>3 parts by weight | N-04<br>2 parts by weight<br>Compound (2-1)<br>1 part by weight | 10.3 μm |
| Example 9 | St/Bu resin<br>87 parts by weight | Colorant 1<br>8 parts by weight | 550P<br>3 parts by weight | PR<br>2 parts by weight | 9.7 μm |
| Example 10 | Resin 1<br>76 parts by weight | Colorant 1<br>20 parts by weight | Carnauba<br>3 parts by weight | Compound (3-1)<br>1 part by weight | 9.9 μm |
| Comparative Example 1 | Resin 2<br>43 parts by weight Resin 3<br>43 parts by weight | Mogal L<br>8 parts by weight | Carnauba<br>3 parts by weight | N-04<br>2 parts by weight<br>Compound (2-1)<br>1 part by weight | 10.0 μm |
| Comparative Example 2 | Resin 2<br>43 parts by weight Resin 3<br>43 parts by weight | Comparative Colorant 1<br>8 parts by weight | Carnauba<br>3 parts by weight | N-04<br>2 parts by weight<br>Compound (2-1)<br>1 part by weight | 10.2 μm |
| Comparative Example 3 | Resin 2<br>37 parts by weight<br>Resin 3<br>37 parts by weight | Comparative Colorant 2<br>20 parts by weight | Carnauba<br>3 parts by weight | N-04<br>2 parts by weight<br>Compound (2-1)<br>1 part by weight | 10.1 μm |

Mogal L: carbon black (manufactured by Cabot Corp.)
Carnauba: Carnauba wax powder, type 1 (manufactured by S. KATO & CO.)
550P: BISCOAL 550P (polypropylene wax, manufactured by Sanyo Chemical Industries, Ltd.)
PETB: tetrabehenate ester of pentarythritol
N-04: BONTRON N-04 (nigrosine dye, manufactured by Orient Chemical)
PR: COPY BLUE PR (triphenylmethane dye, manufactured by Clariant Corp.)
Epoxy resin: Epicron 7050 (epoxy resin, manufactured by DAINIPPON INK and CHEMICALS Inc., softening point: 126° C.)
St/Bu resin: commercially available styrene-butadiene copolymer
Styrene:butadiene = 89:11
Mn: 12,400, Mw: 88,500, softening point: 135° C., Tg: 56° C.

TONER TEST OF EXAMPLES AND COMPARATIVE EXAMPLES

Employing a silicone-coated ferrite carrier (particle diameter: 100 μm) and the toners of the Examples and the Comparative Examples, developing agents having a toner concentration of 5% by weight were prepared, and the following tests were conducted employing the resulting developing agents.

Printing Durability Test

Employing a commercially available high-speed printer (A4 size paper, 220 sheets/min.), 100,000 sheets were continuously printed and the density of the image portion and the surface contamination density were measured, and also the charge amount of the developing agent was measured. The image density and surface contamination were measured or determined employing a Macbeth densitometer RD-918. Surface contamination (fogging) was determined from the difference between the white background image density and the white paper density prior to printing. A difference of less than 0.01 was rated "○", a difference of 0.01 to 0.03 was rated "Δ", and a difference of 0.03 or more was rated "χ". The test was conducted in an environment of 25° C. and relative humidity of 60%. The results are shown in Table 2.

The state of toner dispersion in the developing apparatus was visually observed. A state in which no dispersion was observed was rated "◎", a state in which almost no dispersion was observed but toner contamination was observed by wiping the interior of the apparatus with a rag was rated "○", a state in which dispersion in the apparatus could be visually observed was rated "Δ", and a state in which severe dispersion in the apparatus could be observed was rated "χ". The results are shown in Table 2.

The charge amount was measured by means of a blow-off charge amount measuring machine (manufactured by Toshiba Chemical) after collecting the toner from the interior of the developing apparatus. The results are shown in Table 2.

Measurement of Transfer Efficiency

Employing a commercially-available copying machine, a solid image (100 m long and 20 mm broad) was developed and the copying machine was stopped when the solid image on the photosensitive material passed through the transferring portion by 50%. Then, the image on the photosensitive material after transferring the non-transferred image (solid) was completely peeled off by means of tape (30 mm×20 mm), and the amount of the toner of the non-transferred image and the amount of the toner after transferring were measured. The transfer efficiency (%) was calculated by the following equation. The results are shown in Table 3.

Transfer efficiency (%)={1−(amount of toner after transferring)/(amount of toner of non-transferred image)}×100

Comparison of Charging

After agitating a 100-cc polyethylene container containing 50 g of the developing agent in a ball mill at 115 rpm for 3 minutes, the developing agent was collected and the charge amount was measured employing a blow-off charge amount measuring machine. After agitating for an additional 7 minutes (10 minutes in total), the charge amount was measured in the same manner. The results are shown in Table 3.

Measurement of True Specific Gravity

The true specific gravity of the toner was measured by an air-relative specific gravity hydrometer, Model 930 (manufactured by Beckman Co.). In the measurement, after accurately weighing about 5 g of a sample to four decimal places, decimals, the true volume was determined under the conditions of 2 atm employing the measuring apparatus, and then the true specific gravity was determined by dividing the weight of the sample by the true volume. The results are shown in Table 3.

Fixation Properties Test

With respect to the fixation temperature range, the fixation temperature was determined by the following fixation properties test, and the range between the upper limit and the lower limit was taken as the fixation temperature range.

Employing each of the powdered toners of the Examples and Comparative Examples, the respective test samples were made by forming an unfixed image on paper by means of a printer that employs a commercially-available organic semiconductor as a photosensitive material, and then fixed by passing through a heat roller (oilless type) Ricoh Imagio DA-250 at a speed of 90 mm/second and varying the surface temperature of the heat roller, and then mending tape (manufactured by 3M Corp.) was applied on the image after fixation. The surface temperature range of the heat roller when the ID (image density) after peeling was 90% or more of the original ID and offset did not occur was defined as the "fixation temperature". The results are shown in Table 3.

TABLE 2

| | Printing test | Initial | After printing 10,000 sheets | After printing 50,000 sheets | After printing 100,000 sheets | Toner dispersion |
|---|---|---|---|---|---|---|
| Example 1 | Charge amount | 12 | 13 | 14 | 14 | ○ |
| | Image density | 1.42 | 1.41 | 1.41 | 1.41 | |
| | Surface contamination | ○ | ○ | ○ | ○ | |
| Example 2 | Charge amount | 14 | 15 | 15 | 15 | ◎ |
| | Image density | 1.52 | 1.50 | 1.50 | 1.50 | |
| | Surface contamination | ○ | ○ | ○ | ○ | |
| Example 3 | Charge amount | 16 | 17 | 18 | 18 | ◎ |
| | Image density | 1.45 | 1.45 | 1.43 | 1.43 | |
| | Surface contamination | ○ | ○ | ○ | ○ | |
| Example 4 | Charge amount | 14 | 15 | 15 | 16 | ◎ |
| | Image density | 1.52 | 1.50 | 1.50 | 1.48 | |
| | Surface contamination | ○ | ○ | ○ | ○ | |
| Example 5 | Charge amount | 14 | 14 | 15 | 16 | ◎ |
| | Image density | 1.52 | 1.52 | 1.50 | 1.48 | |
| | Surface contamination | ○ | ○ | Δ | Δ | |
| Example 6 | Charge amount | 14 | 15 | 15 | 16 | ◎ |
| | Image density | 1.52 | 1.50 | 1.50 | 1.49 | |
| | Surface contamination | ○ | ○ | ○ | ○ | |
| Example 7 | Charge amount | 18 | 20 | 20 | 21 | ◎ |
| | Image density | 1.45 | 1.45 | 1.43 | 1.43 | |
| | Surface contamination | ○ | ○ | ○ | ○ | |
| Example 8 | Charge amount | 18 | 20 | 20 | 21 | ◎ |
| | Image density | 1.42 | 1.41 | 1.41 | 1.41 | |
| | Surface contamination | ○ | ○ | Δ | Δ | |
| Example 9 | Charge amount | 18 | 20 | 20 | 20 | ◎ |
| | Image density | 1.45 | 1.45 | 1.43 | 1.43 | |
| | Surface contamination | ○ | ○ | ○ | ○ | |
| Example 10 | Charge amount | 12 | 13 | 13 | 14 | Δ |
| | Image density | 1.42 | 1.41 | 1.41 | 1.41 | |
| | Surface contamination | ○ | ○ | ○ | ○ | |
| Comparative | Charge amount | 8 | 12 | 12 | 12 | ○ |
| Example 1 | Image density | 1.62 | 1.61 | 1.58 | 1.58 | |
| | Surface contamination | x | Δ | Δ | Δ | |
| Comparative | Charge amount | 7 | 10 | 10 | 11 | Δ |
| Example 2 | Image density | 1.51 | 1.49 | 1.49 | 1.47 | |
| | Surface contamination | X | Δ | Δ | Δ | |
| Comparative | Charge amount | 6 | 9 | 9 | 10 | X |
| Example 3 | Image density | 1.41 | 1.38 | 1.38 | 1.36 | |
| | Surface contamination | X | X | X | Δ | |

TABLE 3

| | Fixation width | | Charging characteristics Charge amount (μc/g) | | True specific gravity |
|---|---|---|---|---|---|
| | ° C. | Transfer efficiency % | 3 min. | 10 min. | g/cm³ |
| Example 1 | 130–210 | 85 | 12 | 13 | 1.55 |
| Example 2 | 120–210 | 86 | 12 | 14 | 1.41 |
| Example 3 | 120–210 | 87 | 14 | 16 | 1.40 |
| Example 4 | 125–210 | 87 | 13 | 14 | 1.40 |
| Example 5 | 135–210 | 86 | 12 | 13 | 1.41 |
| Example 6 | 120–190 | 85 | 12 | 14 | 1.42 |
| Example 7 | 140–210 | 86 | 17 | 18 | 1.31 |
| Example 8 | 130–210 | 87 | 16 | 17 | 1.40 |
| Example 9 | 140–210 | 86 | 17 | 18 | 1.42 |
| Example 10 | 130–210 | 86 | 12 | 14 | 1.58 |
| Comparative Example 1 | 120–210 | 82 | 6 | 12 | 1.35 |
| Comparative Example 2 | 120–210 | 82 | 5 | 10 | 1.48 |
| Comparative Example 3 | 130–210 | 81 | 5 | 9 | 1.60 |

Example 11

| Production of toner | |
|---|---|
| Resin 4 | 87 parts by weight |
| Colorant 1 | 8 parts by weight |
| Compound (6-3) | 2 parts by weight |
| Purified carnauba wax powder, type 1 (manufactured by S. KATO & CO.) | 3 parts by weight |

Employing a Henschel mixer, the above raw materials were mixed, and then the mixture was melt-kneaded by a twin-screw extruder, cooled, finely ground by a jet mill, and fractionated to produce a toner having an average particle diameter of 8.0 μm.

With respect to 100 parts by weight of the toner, 1 part by weight of silica "NAX50" and 1 part by weight of silica "RY-200" manufactured by Nippon Aerosil, were added to the exterior of the toner to obtain the toner of Example 11.

In the same manner, toners were produced according to the formulation shown in Table 4 and the addition step was conducted in the same manner as in Example 11, producing the toners of Examples 12 to 15 and Comparative Examples 4 and 5.

TABLE 4

| | Resin | Colorant | Wax | Charge control agent | Average particle size | True specific gravity |
|---|---|---|---|---|---|---|
| Example 11 | Resin 4<br>87 parts by weight | Colorant 1<br>8 parts by weight | Carnauba<br>3 parts by weight | Compound (6-3)<br>2 parts by weight | 8.0 μm | 1.40 |
| Example 12 | Resin 4<br>80 parts by weight | Colorant 1<br>15 parts by weight | Carnauba<br>3 parts by weight | Compound (4-1)<br>2 parts by weight | 7.8 μm | 1.49 |
| Example 13 | Resin 4<br>80 parts by weight | Colorant 1<br>15 parts by weight | PETB<br>3 parts by weight | Compound (5-1)<br>2 parts by weight | 8.1 μm | 1.49 |
| Example 14 | Resin 4<br>80 parts by weight | Colorant 1<br>15 parts by weight | Carnauba<br>3 parts by weight | E-84<br>2 parts by weight | 8.1 μm | 1.49 |
| Example 15 | Resin 5<br>87 parts by weight | Colorant 1<br>8 parts by weight | 550P<br>3 parts by weight | Compound (6-1)<br>2 parts by weight | 7.8 μm | 1.31 |
| Comparative Example 4 | Resin 4<br>87 parts by weight | Mogal L<br>8 parts by weight | Carnauba<br>3 parts by weight | Compound (6-3)<br>2 parts by weight | 8.0 μm | 1.42 |
| Comparative Example 5 | Resin 4<br>87 parts by weight | Comparative Colorant 1<br>8 parts by weight | Carnauba<br>3 parts by weight | Compound (6-3)<br>2 parts by weight | 8.2 μm | 1.50 |

E-84: BONTRON E-84 (metal complex of salicylic acid, manufactured by Orient Chemical)

Printing Durability Test

After a special purpose toner was extracted from a cartridge of a commercially-available printer of a non-magnetic one-component development system ("IPSIO COLOR 2000", manufactured by RICOH Co., Ltd.) and the cartridge was cleaned, the cartridge was filled with the toners of the Examples and Comparative Examples shown in Table 4, and then 10,000 sheets were continuously printed at an image density of 5%. The test was conducted in an environment of 25° C. and 60%.

Image Density/Surface Contamination (Fogging)/ Charge Amount

The image density and surface contamination of printouts were measured or determined employing a Macbeth densitometer RD-918. Surface contamination was determined from the difference between the white background image density and the white paper density prior to printing. A difference of less than 0.01 was rated "○", a difference of 0.01 to 0.03 was rated "Δ", and a difference of 0.03 or more was rated "χ" . The charge amount of the printing toner was measured employing a suction type portable charge amount measuring apparatus, Model 210HS (manufactured by TREK). The results are shown in Table 5.

Toner Falling/Toner Dispersion

A state in which the interior of the machine was not contaminated as a result of toner falling from the development sleeve mounted to the cartridge (toner falling) or dispersion of the toner in the vicinity of the developing apparatus (toner dispersion) after printing 10,000 sheets was rated "○", a state in which less toner falling or toner dispersion was recognized was rated "Δ", and a state in which a large amount of toner falling or toner dispersion was recognized was rated "χ". The results are shown in Table 5.

TABLE 5

| | Toner falling/toner dispersion Initial/after printing 10,000 sheets | Image density Initial/after printing 10,000 sheets | Surface contamination Initial/after printing 10,000 sheets | Charge amount (μC/g) |
|---|---|---|---|---|
| Example 11 | ○/○ | 1.42/1.45 | ○/○ | −11.5 |
| Example 12 | ○/○ | 1.41/1.43 | ○/○ | −12.0 |
| Example 13 | ○/○ | 1.40/1.43 | ○/○ | −12.8 |
| Example 14 | ○/○ | 1.42/1.44 | ○/○ | −12.7 |
| Example 15 | ○/○ | 1.41/1.43 | ○/○ | −13.8 |
| Comparative Example 4 | Δ/Δ | 1.40/1.44 | Δ/Δ | −12.3 |
| Comparative Example 5 | Δ/X | 1.49/1.53 | Δ/x | −9.8 |

What is claimed is:

1. A toner for electrostatic image development comprising a binder resin and a colorant, wherein the colorant is made of black fine particles obtained by coating a surface of titanium dioxide particles with a complex oxide of titanium and iron.

2. The toner for electrostatic image development according to claim 1, wherein the complex oxide of titanium and iron is $Fe_2TiO_4$.

3. The toner for electrostatic image development according to claim 1, wherein the black fine particles have a residual magnetization of 10 $Am^2/kg$ or less.

4. The toner for electrostatic image development according to claim 1, which has a true specific gravity of 1.50 or less.

5. The toner for electrostatic image development according to claim 1, which has a true specific gravity of 0.70 to 1.45.

6. The toner for electrostatic image development according to claim 1, further comprising, as a charge control agent, one or more compounds selected from nigrosine dye, modified nigrosine dye, and triphenylmethane dye, and a compound having a quaternary ammonium salt structure.

7. The toner for electrostatic image development according to claim 6, wherein the compound having a quaternary ammonium salt structure is a compound represented by formula 1:

(Formula 1)

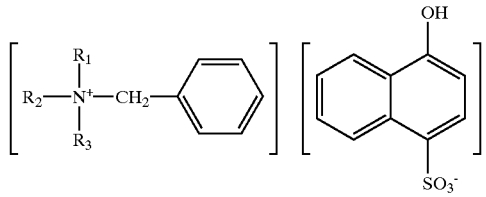

wherein $R_1$, $R_2$, and $R_3$ each independently represents an alkyl group having 1 to 10 carbon atoms.

8. The toner for electrostatic image development according to claim 6, wherein the compound having a quaternary ammonium salt structure is a compound represented by formula 2:

(Formula 2)

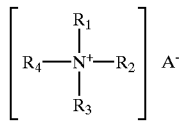

wherein $R_1$, $R_2$, $R_3$, and $R_4$ each independently represents a hydrogen atom, an alkyl or alkenyl group having 1 to 22 carbon atoms, a non-substituted or substituted aromatic group having 1 to 20 carbon atoms, or an aralkyl group having 7 to 20 carbon atoms, and $A^{31}$ represents a molybdate anion or a tungstate anion, or a heteropoly-acid anion having a molybdenum or tungsten atom.

9. The toner for electrostatic image development according to claim 6, wherein the compound having a quaternary ammonium salt structure is a compound represented by formula 3:

(Formula 3)

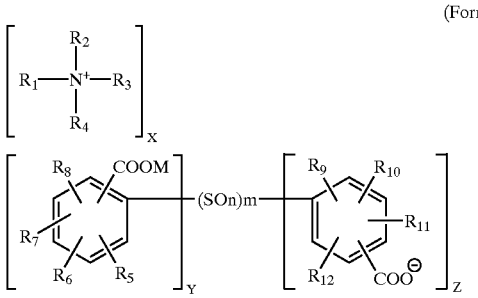

wherein m represents an integer of 1 to 3; n represents an integer of 0 to 2; X and Z represent 1 or 2, Y represents 0 or 1; Y=1 and Z=1 when X=1; Y=0 and Z=2 when X=2; M represents a hydrogen atom or a monovalent metal ion; $R_1$, $R_2$, $R_3$, and $R_4$ represent a hydrogen atom, a straight-chain or branched saturated or unsaturated alkyl group having 1 to 30 carbon atoms, an oxyethyl group represented by the formula $(—CH_2CH_2O)_p—R$, provided that R represents a hydrogen atom or an alkyl or acyl group having 1 to 4 carbon atoms, and p represents an integer of 1 to 10, a monocyclic or polycyclic aliphatic group having 5 to 12 carbon atoms, or a monocyclic or polycyclic aromatic group; and $R_5$ to $R_{12}$ represent a hydrogen atom, a straight-chain or branched saturated or unsaturated alkyl group having 1 to 30 carbon atoms, an alkoxyl group having 1 to 4 carbon atoms, or a polyoxyalkylene group represented by the formula $(—C_qH_{2q}—O)_r—R$, provided that R represents a hydrogen atom or an alkyl or acyl group having 1 to 4 carbon atoms, q represents an integer of 2 to 5, and r represents an integer of 1 to 10.

10. The toner for electrostatic image development according to claim 1, further comprising, as a charge control agent, one or more compounds selected from a metal complex of salicylic acid, a metal complex of benzilic acid, a metal complex of an azo compound, and a compound represented by formula 4:

(Formula 4)

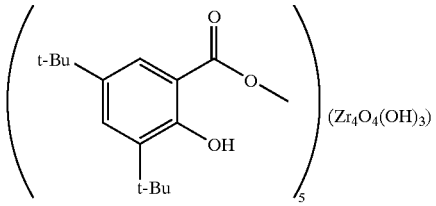

11. The toner for electrostatic image development according to claim 1, wherein the binder resin is a polyester resin.

* * * * *